United States Patent [19]

St. Germain

[11] 4,441,748

[45] Apr. 10, 1984

[54] STRIP THIMBLE

[76] Inventor: Dennis St. Germain, 19 Stonecrop Rd., Wilmington, Del. 19801

[21] Appl. No.: 367,391

[22] Filed: Apr. 12, 1982

[51] Int. Cl.[3] ..... B66C 1/12

[52] U.S. Cl. ..... 294/74

[58] Field of Search ..... 294/74, 77, 149, 156; 24/16 R, 115 R, 122.3; 190/37; 206/453, 583, 586, 597; 224/264

[56] References Cited

U.S. PATENT DOCUMENTS

| | | | |
|---|---|---|---|
| Re. 26,704 | 11/1969 | Norton | 294/74 |
| 2,567,872 | 9/1951 | Burke | 294/74 X |
| 3,622,025 | 11/1971 | Petersen | 294/74 X |
| 3,647,170 | 3/1972 | Beeker et al. | 294/74 X |
| 4,039,217 | 8/1977 | Bryant | 294/74 |
| 4,039,218 | 8/1977 | Bryant | 294/74 |
| 4,045,072 | 8/1977 | Brown | 294/74 |
| 4,124,244 | 11/1978 | Bryant | 294/74 |

*Primary Examiner*—Johnny D. Cherry

*Attorney, Agent, or Firm*—Anthony J. McNulty; James H. Knebel

[57] ABSTRACT

A means for protecting hoisting slings and/or their loads is described. The device includes a strip of uniform width and indefinite length comprising multiple plies of woven webbing, a plurality of spaced channels between a first pair of adjacent plies, and a plurality of friction straps, each secured at one end between a second pair of adjacent plies so that the opposed free end extends perpendicularly from a longitudinal edge of the strip. Each friction strap corresponds to one of the plurality of channels and is about as wide as its corresponding channel so that it fits snugly therein. The device is interposed between the sling and the load and is attached to the sling by encircling the sling cable with the straps and passing them through their corresponding channels so that the sling is firmly engaged by the device.

7 Claims, 4 Drawing Figures

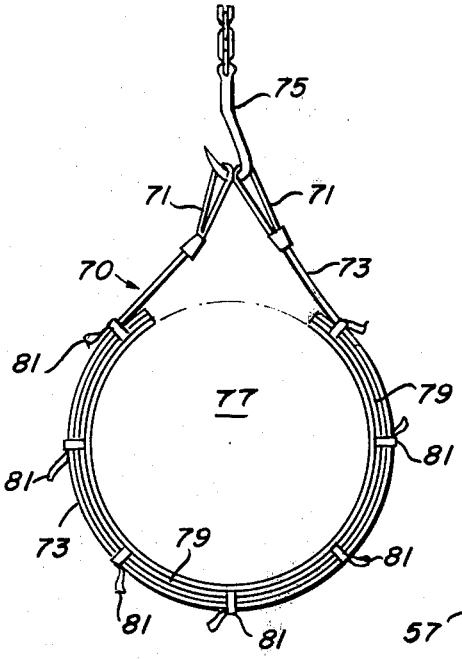
Fig. 4
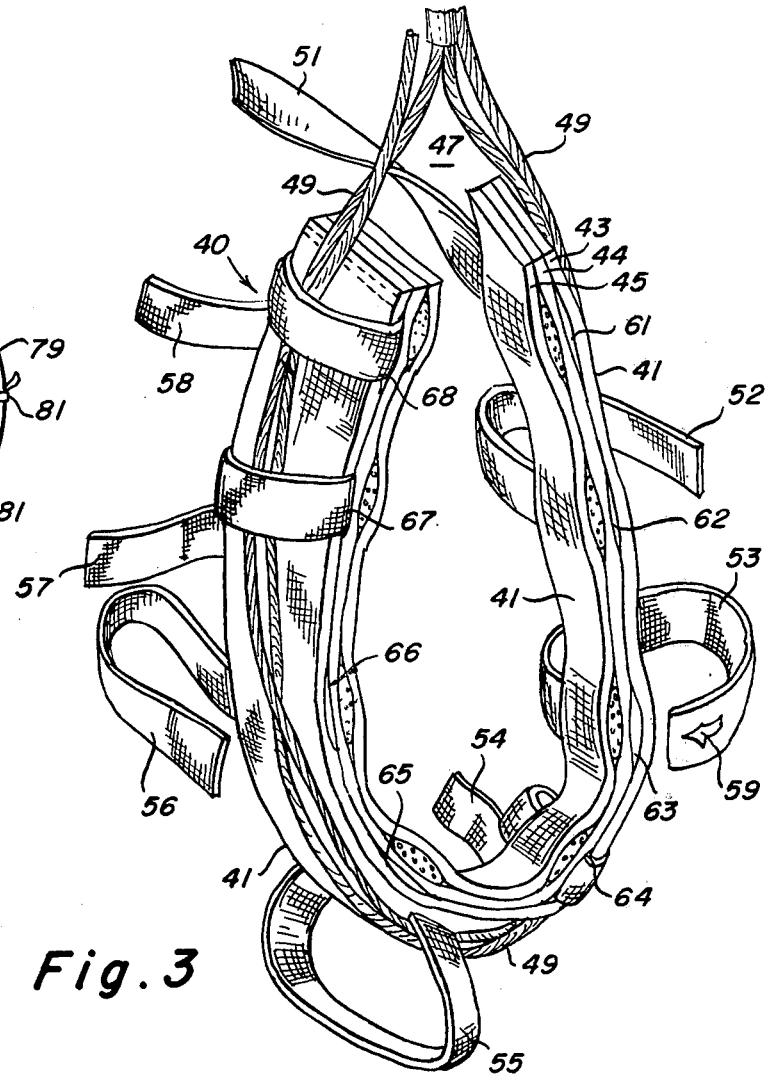
Fig. 3
Fig. 2
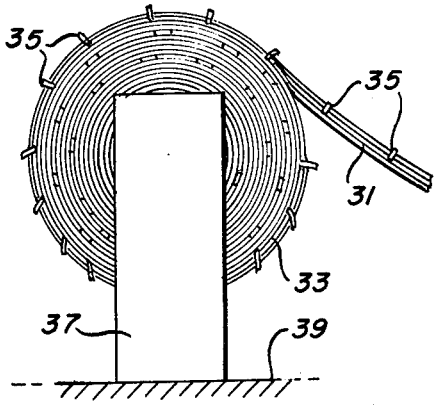
Fig. 1
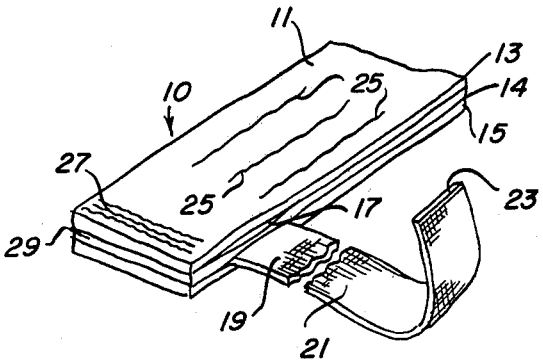

STRIP THIMBLE

This invention relates to a protective covering for hoisting slings made from wire rope, metal cable, or equivalents. More specifically, this invention relates to a thimble device for hoisting slings and the like comprising a fabric strip which is interposed between the wire rope, cable, etc. and a load or a hook suspended from a hoist to cushion the compressive forces being applied to the sling and to protect the sling and/or the load from abrasive, frictional or other such damage.

BACKGROUND OF THE INVENTION

Protective sling coverings are known in the prior art. For example, a clutch pad for a lift sling is disclosed in U.S. Pat. No. 4,039,217 issued to Bryant which comprises multiple fabric plies disposed between a load and a sling for lifting the load, the inner surfaces of the plies having slide permitting means to permit relative sliding motion between the plies and between the load and the sling without the load and the sling being in direct contact. The clutch pads include straps and strap extensions sewn onto and across the ends of the plies to provide means to attach the plies to the sling as by tieing. In U.S. Pat. No. 4,039,218, also issued to Bryant, tubular clutch pads for lift slings are taught which also permit relative sliding motion between the plies making up the pad and between the load and the sling without the load and the sling being in direct contact.

Such prior art coverings must be manufactured in a multitude of predetermined fixed lengths in order to fit the assorted sizes of slings available in the trade. Thus, the hoist operator must maintain a complete inventory of coverings for each type or size of sling or load to be encountered during the normal course of business. The sling covering manufacturer too must be able to provide this variety to the trade.

Fabric lifting slings are also known in the prior art. U.S. Pat. No. 2,985,480 issued to Otley and Re. 26,704 issued to Norton disclose such slings which are used to lift or otherwise handle loads which may be easily scratched, marred or defaced. Such slings are, however, not durable enough for extended usage or extremely heavy loads. Once wear is noticed on the contact surfaces of such a sling, it must be replaced with a new sling for fear that the worn surfaces will tear while lifting the load.

SUMMARY OF THE INVENTION

It is an object of this invention to provide a thimble means for use in combination with flexible metal lifting and hoisting slings to protect such slings and/or the load they carry from damage by abrasion, friction and the like.

It is also an object of this invention to provide a flexible pad or covering for metal cable hoisting slings to be interposed between the sling and the load or the lifting force.

It is additionally an object of this invention to provide protective covering means which is flexible and adaptable to fit inside the eye(s), or along the body, of a conventional hoisting sling.

It is further an object of this invention to provide a strip thimble for hoisting slings available in the trade which can be manufactured in a single size for use with slings or loads of various dimensions.

Other objects of this invention will become apparent in the following description, taken in conjunction with the accompanying drawings.

BRIEF DESCRIPTION OF THE DRAWINGS

FIG. 1 is a perspective view of a single unit, viz., an end unit, of a protective covering according to the instant invention, a plurality of which units in strip form provide the thimble means of the present invention.

FIG. 2 is a plan view of the protective covering of the present invention being unwound from a supply spool or mandrel mounted on an appropriate holder.

FIG. 3 is a perspective view of a strip thimble of the present invention being installed in the eye of a hoisting sling typical of those currently in use in the trade.

FIG. 4 is a plan view of a strip thimble of the present invention installed along the body of a hoisting sling and interposed between the sling and the load being lifted by the hoist.

DESCRIPTION OF THE PREFERRED EMBODIMENT OF THE INVENTION

The term "strip thimble" is defined as a comparatively long device of uniform width which longitudinally covers a single aspect of a flexible metal cable sling or the like for interposition between the sling and another contacting surface. As used herein, a "strip thimble" is the equivalent of a protective covering for a cable sling.

The strip thimble of the present invention comprises a plurality of units as shown in FIG. 1. Each unit 10 comprises a fabric strip 11 which includes at least three plies 13, 14, 15 of woven webbing, such as industrial grade woven nylon webbing. The plies or webs 13, 14, 15 are of uniform width which may range between two inches and about five or six inches. Webbing of about two or three inches across is preferred because it can accommodate the largest variety of metal cable slings now in use, such as, for example, the light duty cable slings described by St. Germain in U.S. Pat. No. 4,043,581. However, for heavy duty compound slings, such as those disclosed in U.S. Pat. No. 4,240,659, webs of even wider dimensions than noted above may be employed.

Unit 10 also includes lateral channel 17 between plies 13 and 14 and friction strap 19, one end of which is secured between plies 14 and 15. As explained in more detail in reference to FIG. 3, channel 17 and friction strap 19, in combination, function as means for attaching, and maintaining the attachment of, fabric strip 11 of the strip thimble to the hoisting sling. In order to perform their function, the width of channel 17 must be substantially identical to, or only slightly larger than, the cross-sectional dimensions of strap 19 so that free end 21 of strap 19 is capable of fitting snugly in channel 17 without distortion and is generally resistant to longitudinal movement or displacement while in channel 17. Because of this close tolerance, some difficulty may, of course, be encountered in sliding strap 19 between plies 13 and 14 in channel 17. Therefore, the use of an appropriate tool, for example, a pair of long nose pliers, may be necessary for grasping free end 21 of strap 19 and forcing its passage through channel 17. To prevent unravelling of the fibers at the leading edge of strap 19, as might occur when free end 21 is repeatedly forced through channel 17, bead 23 may be formed along the edge by contacting it with a hot surface to fuse the cut fibers.

As shown in FIG. 1, a portion of one end of strap 19 is secured between plies 14 and 15 and the opposite or free end 21 extends perpendicularly from one longitudinal edge of strip 11. The path of channel 17, passing transversely across strip 11 between plies 13 and 14, is likewise perpendicular to strip 11. Moreover, the lateral limits of channel 17 and of the secured end of strap 19 between plies 14 and 15 are in generally parallel planes as they extend perpendicularly from the longitudinal edges of strip 11. The length of strap 19 secured between plies 14 and 15 should be equal to the full width of strip 11 to assure that the top and bottom surfaces of unit 10 are as smooth and as level as possible.

Strap 19 is typically made of the same material as plies 13, 14, 15 of strip 11 but, in the preferred embodiment of this invention, is of a narrower dimension by about fifty percent or more. No distinct advantage appears to result by the use of friction straps greater than about one inch across. The length of strap 19, however, may vary widely depending primarily on the size of the cable or sling. As a general rule, when strap 19 is secured in unit 10 as illustrated in FIG. 1, free end 21 should be capable of being wrapped at least one and one-half times around fabric strip 11 so that a sufficient length of free end 21 is available to pass completely through and extend several inches beyond the exit end of channel 17 whenever unit 10 is in place on a cable sling. Accordingly, free end 21 should measure no less than about six inches in length. For a light duty sling, the total length of strap 19, therefore, may range between about nine and about fifteen or eighteen inches.

As stated previously, the protective covering of the instant invention comprises a plurality of the units shown in FIG. 1. Preferrably, the covering should comprise no fewer than three repetitions of unit 10. In other words, the strip thimble according to the present invention includes an adequate length of strip 11 comprising at least three plies of webbing 13, 14, 15 having incorporated therein at least three combinations of channel 17 and friction strap 19, which combinations function as means for attaching the strip thimble to the cable or sling. Thus, it is within the scope of this invention to provide a strip thimble having twenty, thirty or more channel 17–strap 19 combinations. This plurality of straps 19 may extend from the same longitudinal edge of strip 11 or, optionally, alternate straps 19 may extend from opposite longitudinal edges.

It should be kept in mind that as the number of attaching means for a particular length of strip thimble are reduced, the arrangement of fabric strip 11 on a stretch of cable tends to become more easily displaced, such as by rotation about the cable. Such displacement, of course, defeats the advantages of using the cable covering. In consideration of this tendency, therefore, it is preferred to closely space a number of channel 17–friction strap 19 combinations along the extent of strip 11 so that unit 10 of FIG. 1 repeats within a range of about every one to six inches. The repetitions may be regular or irregular. The close proximity of the combinations insures that a relatively short piece of strip thimble according to the present invention, such as might be used in protecting a sling or cable of small dimension, will have adequate attachment means to maintain its disposition in relation to the sling or cable. However, when comparatively longer stretches of cable are to be covered and the number of channel 17–strap 19 combinations are so closely spaced that they are superfluous for maintenance of the attachment and disposition of the coverings, some of straps 19 may be left unengaged in their respective channels 17 or, alternatively, may be severed from the units. Either of these two options effectively lengthen the repetitions of the attaching means of unit 10 but care should be taken not to space the attaching means beyond, say, six to ten inch intervals because the stability of the attachment then becomes a factor.

To form the strip thimble of the present invention, plies 13, 14, 15 of uniform width and of equal but indefinite length and a plurality of straps 19 are fastened together in such a manner that channel 17 is maintained open and unobstructed in each repeating unit 10 along the entire length of strip 11. As can best be seen in FIG. 1, the fastening is preferably achieved by means of several lines of staples or stitches 25. Alternatively, resinous adhesives well known in the trade may be employed, as well as combinations of staples, stitches and/or adhesives. One or more rows of lateral staples or stitches 27 may be applied along the leading and trailing edges of strip 11 to strengthen the bonding of plies 13, 14, 15 at the terminal extremities. Bead 29 may also be formed on opposite extremities of fastened strip 11 by contacting the edges of plies 13, 14, 15, collectively, with a hot surface. Alternatively, plies 13, 14, 15 may be beaded individually prior to assembly.

The preferred method of forming the strip thimble involves the steps of first adhering the plurality of straps 19 between plies 14 and 15 by means of a glue or adhesive, then overlaying this assembly with ply 13 and sewing two or three lines of stitches 25 in the longitudinal spaces between the intersecting adhered end portions of straps 19, thereby forming between plies 13 and 14 a plurality of channels 17 having essentially the same dimensions as the adhered end portions of straps 19. During the glueing operation, care should be taken to position each of the straps 19 at right angles relative to plies 14 and 15, although a deviation of five or ten degrees is permissable. The strip thimble produced by this method is a somewhat stiff but still very flexible belt or strip which is capable of being twisted, bent, coiled or wound and of returning to a substantially flat or planar condition.

According to a specific embodiment of this invention, the strip thimble may be of indefinite length and wound upon a spool or mandrel. Thus, as illustrated in FIG. 2, a portion of strip thimble 31 may be unwound from supply spool 33 as needed at the site of use, then cut and trimmed to custom fit a particular sling requirement. Friction straps 35 may hang loosely from one or both edges of strip thimble 31 on spool 33 or, optionally, may be engaged in their respective channels (not shown) or merely folded over and interleaved in each successive winding of strip thimble 31. For convenience of use, spool 33 may be retained in holder 37 which, in turn, may be mounted on a suitable surface 39, such as the bed of the crane or hoist, or a supply truck.

Referring now to FIG. 3, a section of the sling covering of the present invention is shown being attached to the eye of a three part light duty cable sling, such as is disclosed in U.S. Pat. No. 4,043,581. As illustrated, a cut section of flexible strip thimble 40 comprising a bonded fabric strip 41 of three nylon plies 43, 44, 45 is fitted inside of eye 47 of a three part sling. Strip 41 is attached to cable 49 of eye 47 by means of eight spaced friction straps 51 through 58, end portions of each of which are secured between plies 44 and 45 of strip 41. As progressively shown in FIG. 3, each of the flexible free ends of straps 52 through 58 is looped around behind strip 41 in the direction of arrow 59, thereby encircling cable 49, and is immediately passed into one end of eight similarly spaced channels 61 through 68 between plies 43 and 44 and out the other end. Strap 51 represents a strap prior to initiation of the attachment process; straps 52 and 56 are looping behind strip 41; straps 53 and 55 are almost completely encircling cable 49 and are approaching the openings of channels 63 and 65, respectively; strap 54 is depicted as threaded part of the way through channel 64; and straps 57 and 58 are completely pulled through channels 67 and 68, respectively, so that the straps, together with outside ply 43 of strip 41, fully encompass and engage cable 49.

FIG. 4 demonstrates the use of the strip thimble of the instant invention in association with a compressive load. Sling 70, consisting of two eye portions 71 and body portion 73, is attached to hook 75 suspended from a hoist or like machinery and encircles load 77, which for the sake of convenience is depicted as a cylindrical object. Strip thimble 79 is connected to body portion 73 by means of seven friction straps 81 and related channels (not shown) and is, thereby, sandwiched between body portion 73 and load 77 to absorb the applied compressive forces to these parts as they depend from hook 75. The attachment of the protective strip thimble 79 to body portion 73 of sling 70 is very firm due to the friction that is generated while straps 81 are in position in their respective channels.

Numerous variations and modifications of the abovedescribed invention will occur to those skilled in the art in light of this disclosure and the prior art. It is contemplated, therefore, that the present invention may be practiced otherwise than specifically described herein while remaining within the scope of the claims which define the invention.

What is claimed is:

1. Protection means for attachment to a hoisting sling comprising a strip made up of at least three bonded plies of woven webbing of uniform width, a plurality of spaced channels between a first and a second ply of said strip, and a plurality of friction straps secured between said second and a third ply of said strip and extending perpendicularly from a longitudinal edge of said strip, each of said straps corresponding to one of said plurality of spaced channels and having a cross-sectional dimension substantially identical to, or only slightly smaller than, the width of the corresponding channel.

2. The means according to claim 1 wherein the lateral limits of each strap and its corresponding channel are in generally parallel planes as they extend perpendicularly from the longitudinal edge of said strip.

3. The means according to claim 1 wherein the width of said straps is at least fifty percent narrower than the width of said plies.

4. The means according to claim 1 including at least three of said straps.

5. The means according to claim 4 wherein the distance between each of said straps is within the range of about one to ten inches.

6. The means according to claim 1 wherein said strip is of indefinite length and is wound upon a spool.

7. A hoisting sling for lifting a load and a protection means interposed between said sling and said load comprising a strip made up of at least three bonded plies of woven webbing of uniform width and means for attaching said strip to said sling characterized as consisting essentially of a plurality of spaced channels between a first and a second ply of said strip and at least three friction straps secured between said second and a third ply of said strip and extending perpendicularly from a longitudinal edge of said strip, each of said straps corresponding to one of said plurality of spaced channels and having a cross-sectional dimension substantially identical to, or only slightly smaller than, the width of the corresponding channel, said protection means being attached to said sling by passage of said straps through corresponding channels so that said sling is encompassed by said straps and is firmly engaged by said strip.

* * * * *